US005979694A

United States Patent [19]

Bennett et al.

[11] Patent Number: 5,979,694

[45] **Date of Patent: *Nov. 9, 1999**

[54] PRESSURE CANISTER

[75] Inventors: Richard A. Bennett, Smithtown; Röbert L. Benoit, Oakdale; Bernard I. Rachowitz; Glenn L. Spacht, both of Lloyd Neck, all of N.Y.

[73] Assignee: TechMatics, Inc., Hauppauge, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/835,573

[22] Filed: Apr. 9, 1997

[51] Int. Cl.[6] ..... B65D 6/32

[52] U.S. Cl. ..... 220/613; 220/916; 220/612; 220/611; 220/789

[58] Field of Search ..... 220/916, 610, 220/611, 614, 240, 789, 795, 804, 803, 582, 581, 89.1, 612, 613

[56] References Cited

U.S. PATENT DOCUMENTS

| | | | |
|---|---|---|---|
| 1,747,591 | 2/1930 | Moore | 220/804 |
| 2,613,015 | 10/1952 | Keating | 220/612 |
| 2,854,744 | 10/1958 | Crockett . | |
| 2,941,064 | 6/1960 | Gieser, Jr. et al. | 220/612 |
| 2,957,734 | 10/1960 | McLeod | 220/614 |
| 3,070,127 | 12/1962 | Gratzmuller | 220/240 |
| 3,114,085 | 12/1963 | Ruscetta et al. | 220/611 |
| 3,837,755 | 9/1974 | Benoit et al. . | |
| 4,021,342 | 5/1977 | Schacht et al. | 220/611 |
| 4,356,926 | 11/1982 | Priestly et al. | 220/613 |
| 4,443,016 | 4/1984 | Schungel | 220/240 |
| 4,523,872 | 6/1985 | Arena et al. . | |
| 5,413,230 | 5/1995 | Folter et al. | 220/89.1 |

*Primary Examiner*—Stephen Castellano
*Attorney, Agent, or Firm*—Salzman & Levy

[57] ABSTRACT

A pressure vessel, or pressurizable canister is described herein. The canister has a hollow, thin-walled, cylindrical, metal shell. The preferred metal is aluminum, because light weight is a consideration for the vessel. Two end caps are mechanically sealed to the respective distal ends of the metal shell tube by the process of electromagnetic pulse forming. The two end caps are made of a high strength, ductile thermoplastic. The preferred plastic is DELRIN®, which is fabricated from an acetal resin. The plastic end caps are injection molded, and can include reinforcing threads. The end caps are each cylindrically shaped, and have at least one circumferential recess to accommodate the metal of the shell tube as it deforms about the end caps. The tube shrinks into the recess of the end caps, and forms a mechanical seal therewith. An O-ring seal is disposed within at least one circumferential recess of each end cap, to further the ability of the mechanical seal to hold a pressure of at least approximately 300 psi.

14 Claims, 6 Drawing Sheets

PRESSURE CANISTER

FIELD OF THE INVENTION

The present invention relates to pressure canisters, and more particularly to an improved, light weight, pressure canister having a corrosion-resistant tube body that is electromagnetically formed about a pair of distally disposed end caps.

BACKGROUND OF THE INVENTION

The art of fabricating containers and vessels has its roots in antiquity. In modern times, containers and vessels of all types, shapes, and sizes, are fabricated to meet the needs of a rapidly expanding world economy. The present invention is concerned with the manufacture of light weight canisters, capable of storing materials under a pressure of at least approximately 300 psi.

The typical method of fabricating pressure-type canisters is to weld a pair of distally placed closure elements, or end caps, to a metal shell body. Light weight, aluminum canister tube bodies, however, are not conducive to welding. Aluminum welding must be performed in an expensive, inert atmosphere of argon to prevent an oxide coat from forming and interfering with the weld process. More importantly, aluminum tends to anneal and weaken when subjected to welding temperatures, thus necessitating a thicker shell body. The thicker shell adds weight and cost to the finished product, and defeats the light weight objective. The thicker tube shell has the further disadvantage of reducing the amount of material that can be stored in the canister.

The current invention is for a light weight aluminum canister that forms a mechanical seal with its end caps by the method of electromagnetic forming. Electromagnetic forming is a well known process, wherein an electric coil is placed around a metal body, and is thereafter electrically pulsed to create a magnetic field that shapes the metal. In the present application, coils are placed about the distal ends of the shell tube. The coil is then electrified with a high energy voltage pulse of short duration, which magnetically forms and mechanically seals the shell body about the end caps. A typical electromagnetic forming process is described in U.S. Pat. No. 3,837,755, issued to BENOIT et al on Sep. 24, 1974, entitled "Multi-Piece Rod for Control and Structural Members"; and U.S. Pat. No. 4,523,872, issued to ARENA et al on Jun. 18, 1995, entitled "Torsion Resistant Grooved Joint".

The end caps used in the pressure canister of this invention can be formed from a variety of metallic or non-metallic materials. In the preferred embodiment of the inventive canister, the end cap material is a plastic material. A suitable plastic that has been chosen with the required attributes light weight, of strength and ductility is DELRIN®. DELRIN® is an injection moldable thermoplastic, fabricated from an acetal resin. It can be injection molded with reinforcing fibers to provide greater strength and ductility.

SUMMARY OF THE INVENTION

It is an object of this invention to provide an improved pressurizable canister for storing and dispensing volatile materials under pressure.

It is another object of the invention to provide a pressure canister whose seal is formed by an electromagnetic pulse process.

It is a further object of this invention to provide a light weight metal, pressurizable canister that does not require welding of the end caps.

In accordance with the present invention, there is provided a pressure vessel, or pressurizable canister. The canister comprises a hollow, thin-walled, cylindrical, metal shell. The preferred metal is aluminum, since light weight is a consideration for the vessel. Two end caps are mechanically sealed to the respective distal ends of the metal shell tube by the process of electromagnetic pulse forming. The two end caps in the preferred embodiment comprise a high strength, ductile thermoplastic. The preferred plastic is DELRIN®, which is fabricated from an acetal resin. The plastic end caps are injection molded, and can comprise reinforcing fibers. The end caps are each cylindrically shaped, and have at least one circumferential recess to accommodate the metal of the shell tube as it deforms about the end caps. The tube shrinks into the recess of the end caps, and forms a mechanical seal therewith. As an optional feature, an O-ring seal may be disposed within at least one circumferential recess of each end cap, to further the ability of the mechanical seal to hold a pressure of at least approximately 300 psi. The top end cap may have an integrally formed mounting abutment that has a screw thread for attachment purposes. In this instance, a second recess is concentrically disposed in the facial surface of the top end cap in proximity to the mounting abutment. An O-ring is disposed in the second recess.

An alternative design is shown in FIGS. 8, 9, 10, 11 and 12. In this configuration, a quick disconnect and pressure relief valve are combined in the same end cap. A hole is cross drilled between their respective passages to interconnect the two. The second-most inboard O-ring in this cap is meant to act as a wiper to prevent the hydride material from migrating to the primary O-ring pressure seal. This could occur if this is the second end cap assembled after fueling with the hydride material. Note that in this design, no integrally formed mounting abutment and no face seal are required.

BRIEF DESCRIPTION OF THE DRAWINGS

A complete understanding of the present invention may be obtained by reference to the accompanying drawings, when considered in conjunction with the subsequent detailed description, in which.

For the purposes of clarity and brevity, like elements and components will bear the same designation and numbering throughout the figures.

DESCRIPTION OF THE PREFERRED EMBODIMENT

Generally speaking, the invention features a pressure vessel used to store hydrides and other volatile materials. The vessel comprises a cylindrical canister that has a light weight aluminum shell. The shell is mechanically joined to a pair of distally placed, thermoplastic end caps via an electromagnetic forming process. The canister is designed to store, and thereafter dispense, the hydrogen gas from the hydride material at an approximate pressure of at least 300 psi.

Figure 1:
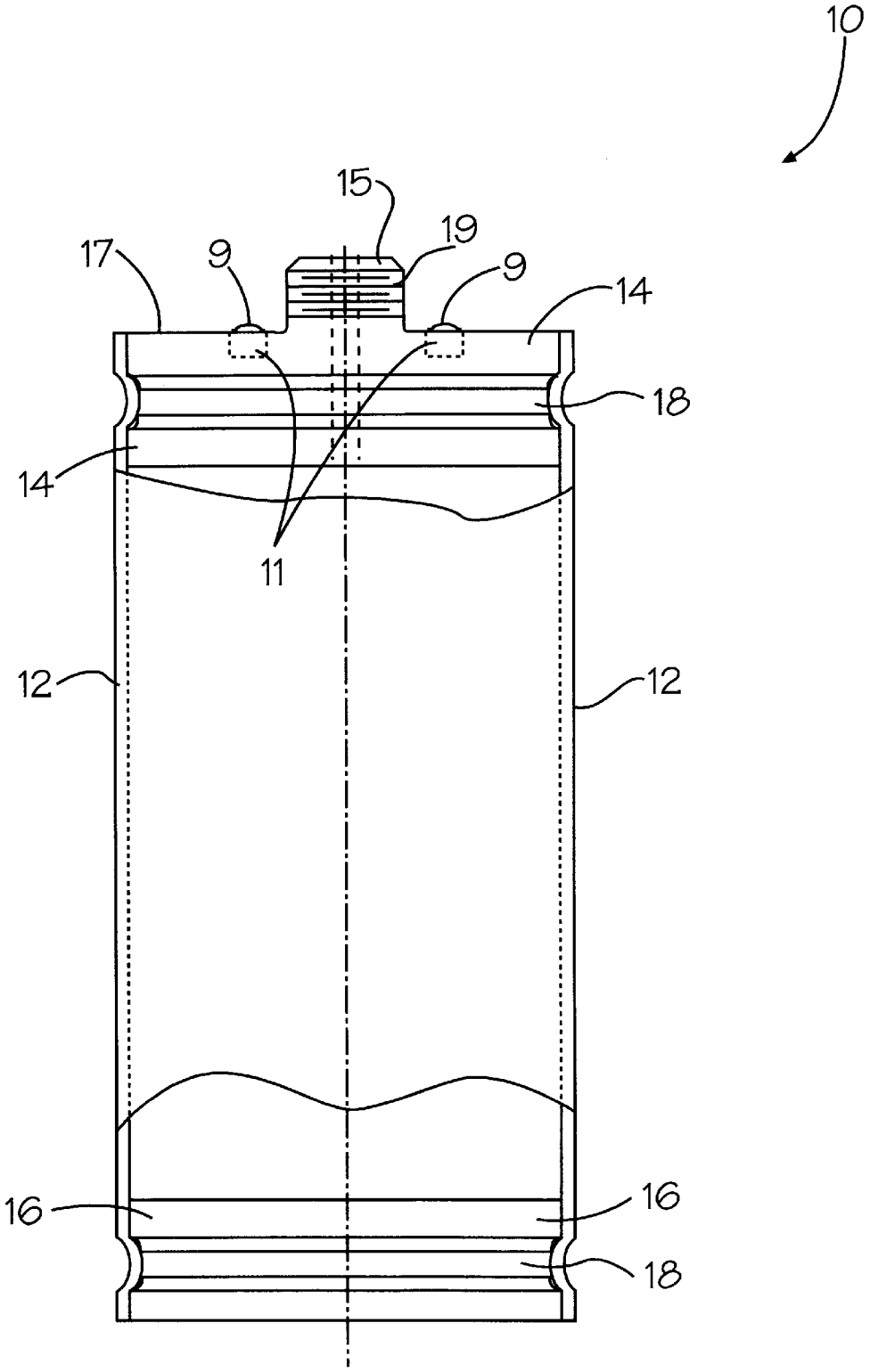
FIG. 1 illustrates a partially cut-away sectional view of the pressurizable canister of this invention.

Now referring to FIG. 1, a pressurizable canister 10, in accordance with the invention, is shown. The canister 10 comprises a thin-walled aluminum shell 12. The shell 12 is mechanically formed about a pair of end caps 14 and 16, respectively, using an electromagnetic forming process.

The electromagnetic pulse forming process is well known, and is described in the aforementioned U.S. Pat. Nos. 3,837,755 and 4,523,872. The aluminum is mechanically deformed into the joints or recess 18 of each end cap 14 and 16, respectively. The end caps 14 and 16 are injection molded from a ductile, high-strength thermoplastic. Ductility is an important characteristic of the chosen plastic, since the plastic must be able to accommodate the shock of the deforming metal without shattering or cracking. A good plastic for this purpose is DELRIN®, an acetal resin based thermoplastic that is easily injection molded.

The end caps 14 and 16, respectively, are each injection molded with the recess 18 disposed in a circumferential surface thereof, as shown. The metal of the shell tube 12 deforms into the recess 18, thus forming a strong mechanical seal. The top end cap 14 may have a mounting abutment 15 extending from a facial surface 17 thereof. The mounting abutment 15 has screw threads 19 molded therein. A concentric groove or recess 11 is disposed on the facial surface 17 in close proximity to the abutment 15. An O-ring 9 is disposed in the groove 11 to enhance the facial seal of the canister with the article to which it is intended to supply the pressurized material.

Figure 2:
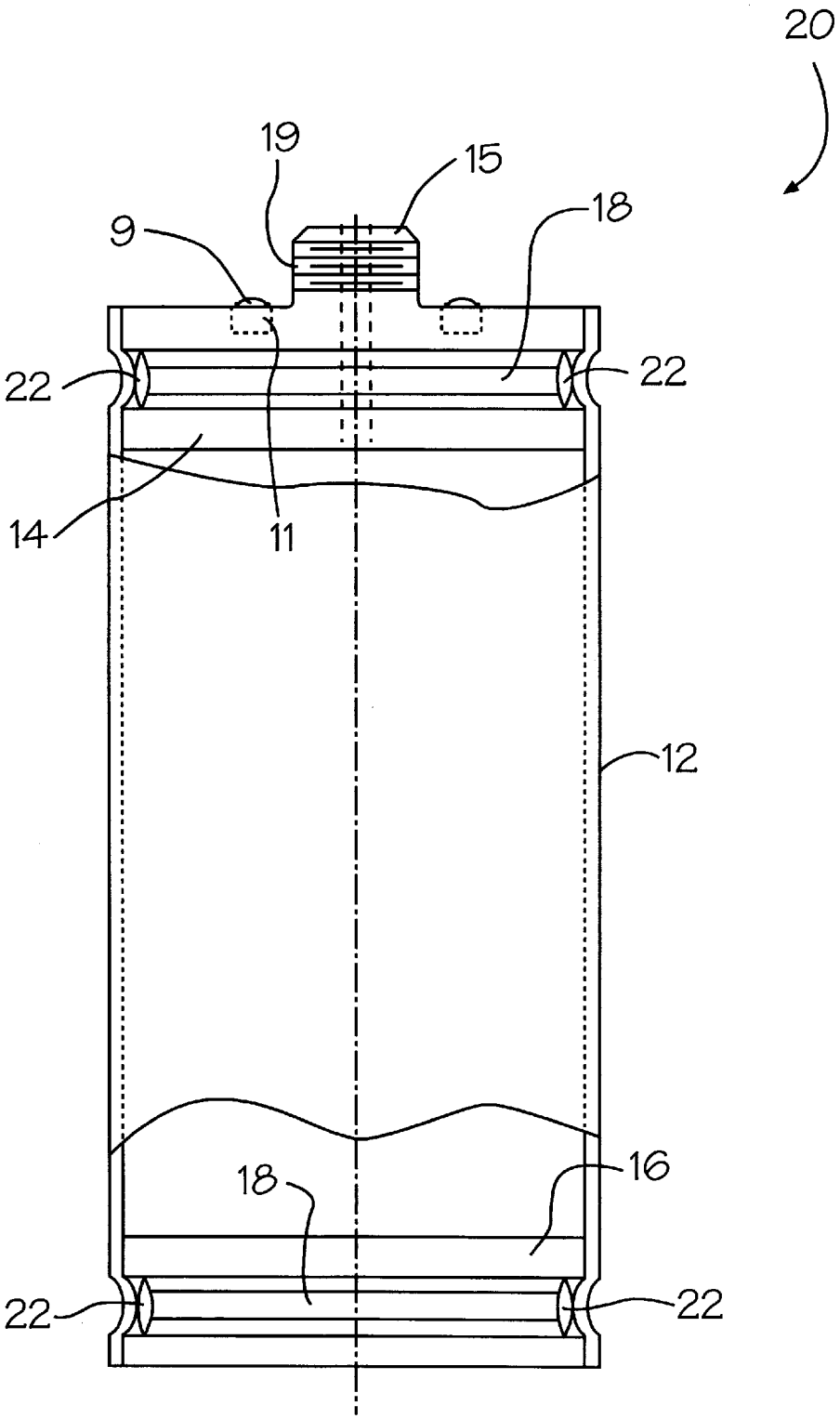
FIG. 2 depicts a partially cut-away sectional view of an alternate embodiment of the pressurizable canister, shown in FIG. 1.

Referring to FIG. 2, a sectional view is illustrated of an alternate embodiment 20 of the canister shown in FIG. 1. The canister 20 comprises an O-ring 22 in each of the respective recesses 18 of end caps 14 and 16. The added O-rings 22 are respectively trapped in the recesses 18, and provide an enhanced sealing between the deformed shell 12 and the end caps 14 and 16, respectively. A better view of the O-ring sealing arrangement can be seen with reference to FIGS. 3, 4 and 6.

Figure 3:
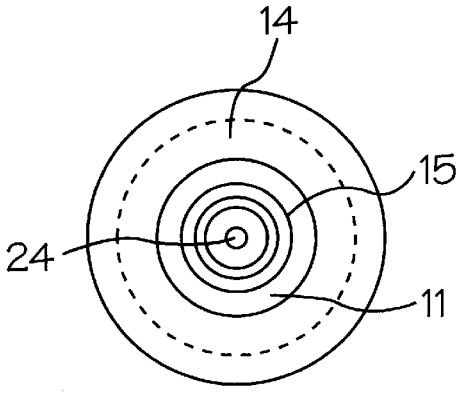
FIG. 3 illustrates a top view of the canisters depicted in FIGS. 1 and 2.
Figure 4:
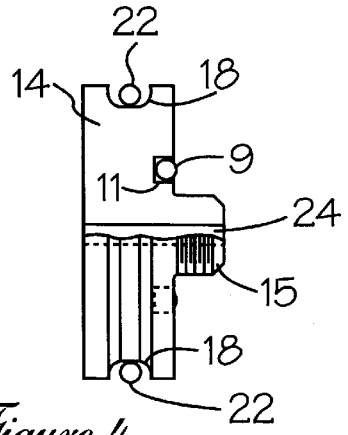
FIG. 4 shows a side view of the top end cap of the canisters illustrated in FIGS. 1 and 2.

Referring to FIGS. 3 and 4, the top end cap 14 is shown in top and side views, respectively. The recess 18 is shown in more detail, and contains O-ring 22. FIG. 4 also illustrates the facial groove 11 and O-ring 9. These FIGURES also depict a passage 24 running through the abutment 15 and end cap 14. The passage 24 allows the pressurized material to pass from the canister 20 into the intended article receiving the stored, and subsequently discharged materials.

Figure 5:
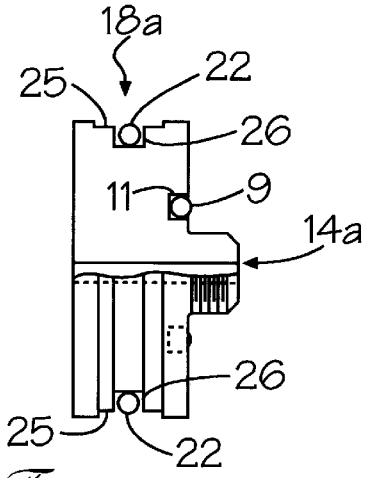
FIG. 5 depicts a side view of an alternate embodiment of the end cap shown in FIG. 4.

Referring to FIG. 5, an alternate embodiment 14*a* is shown for end cap 14 (FIGS. 3 and 4). The end cap 14*a* is illustrated with a circumferential recess 18*a*, which has a double groove represented by grooves 25 and 26, respectively. The second groove 26 captures the O-ring 22 with greater facility.

Figure 6:
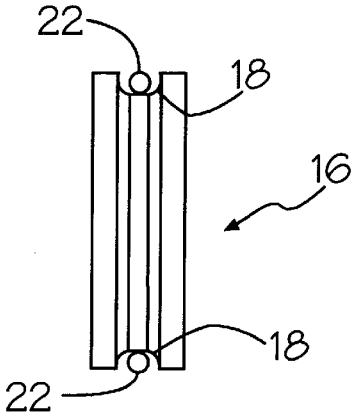
FIG. 6 illustrates a side view of the bottom end cap of the canisters shown in FIGS. 1 and 2.

Referring to FIG. 6, the bottom end cap 16 of the respective canisters 10 or 20 is shown in more detail. The circumferential groove 18 is shown with O-ring 22.

Figure 7:
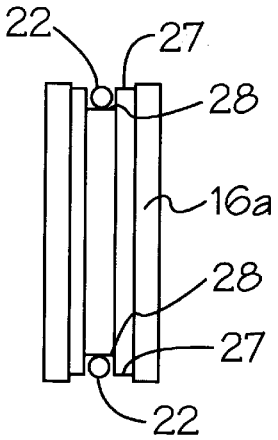
FIG. 7 shows a side view of an alternate embodiment of the bottom end cap, depicted in FIG. 6.

Referring to FIG. 7, an alternate embodiment 16*a* is illustrated of the end cap shown in FIG. 6. The end cap 16*a* features a double groove, comprising respective first and second grooves 27 and 28. The O-ring 22 is better captured in the second groove 28, thus enhancing the seal.

Figure 8:
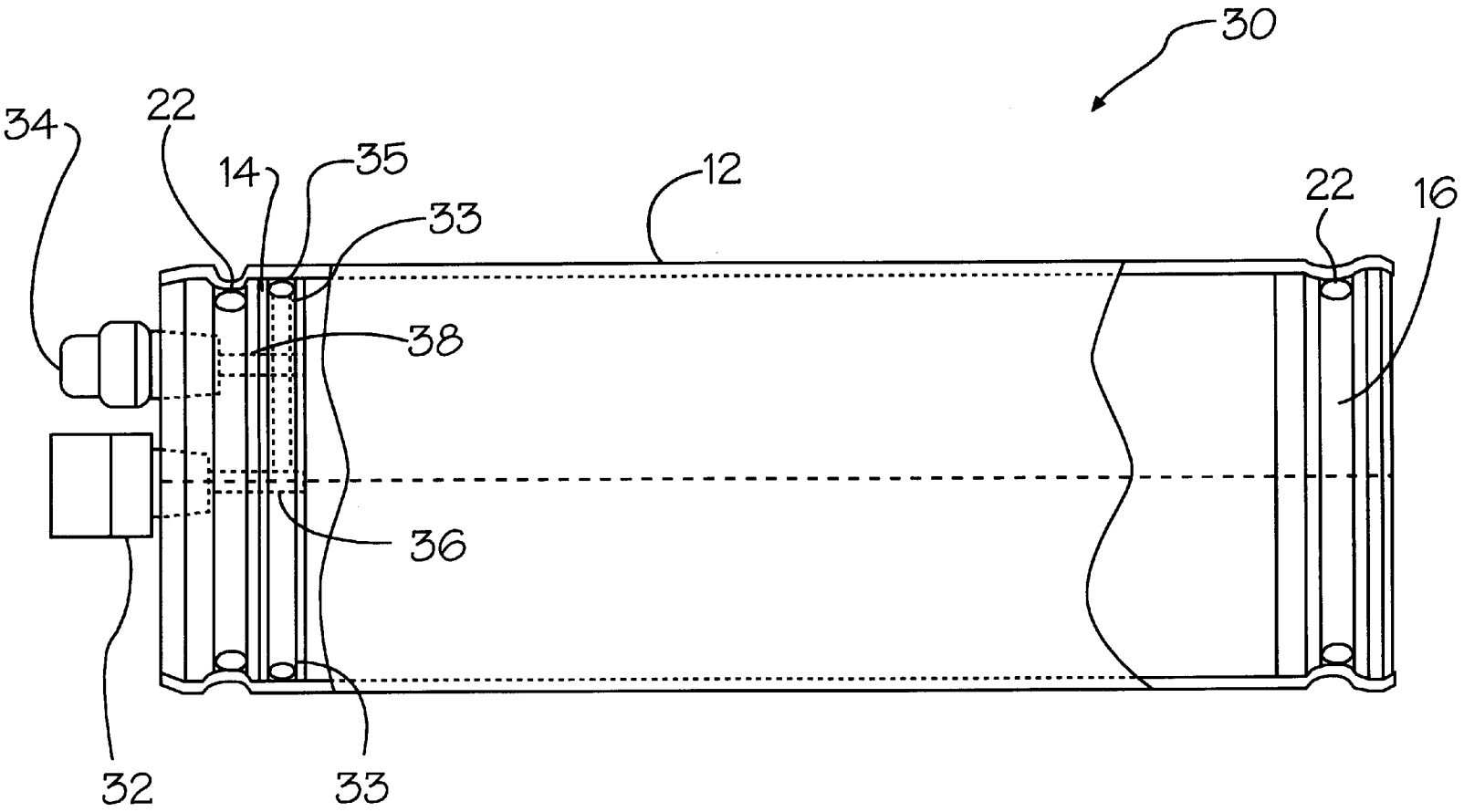
FIG. 8 illustrates a partially cut-away sectional view of an alternative design pressurizable canister incorporating both a quick disconnect and pressure relief valve in the same end cap.

Referring to FIG. 8, a second alternate embodiment 30 of the canister 10 of FIG. 1 is illustrated. The canister 30 comprises a quick disconnect outlet 32 and a pressure relief valve 34, each of which is disposed in the top end cap 14. Both the quick disconnect outlet 32 and the pressure relief valve 34 are screwed into the top end cap 14, via internally threaded bores 36 and 38, respectively. Bore 36 for the quick disconnect outlet 32 passes completely through the top end cap 14, thus communicating with the interior of the canister body 12.

Figure 10:
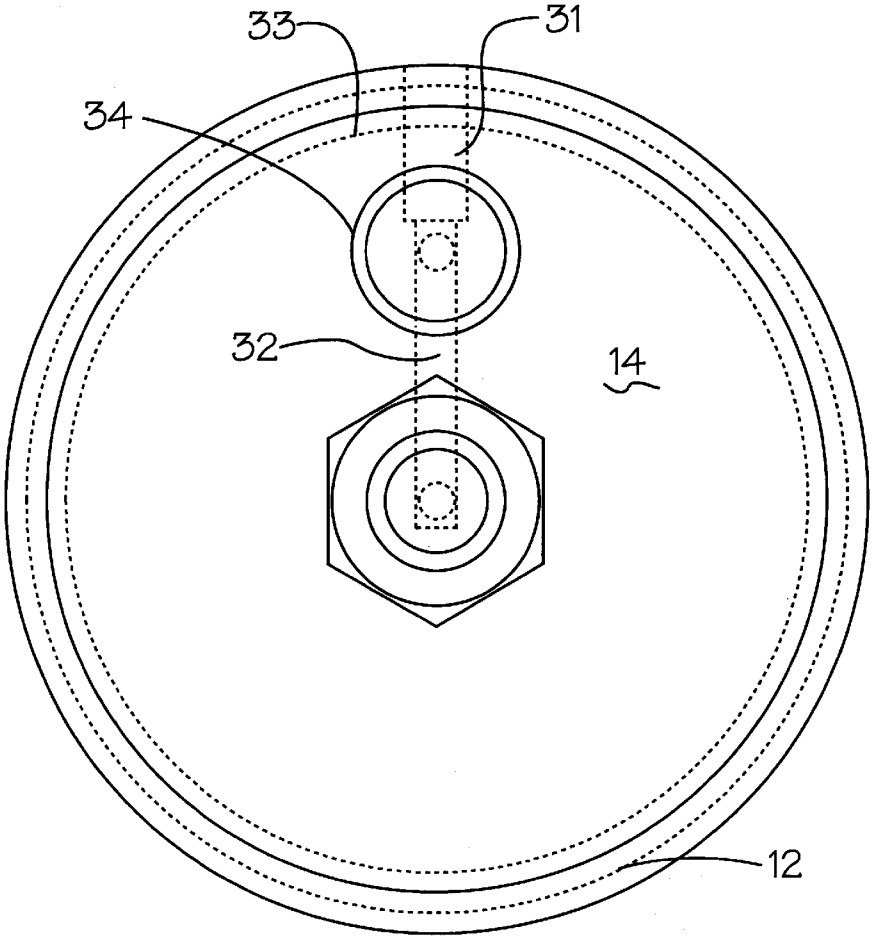
FIG. 10 is a top view of the alternative end cap shown in FIGS. 8 and 9.
Figure 9:
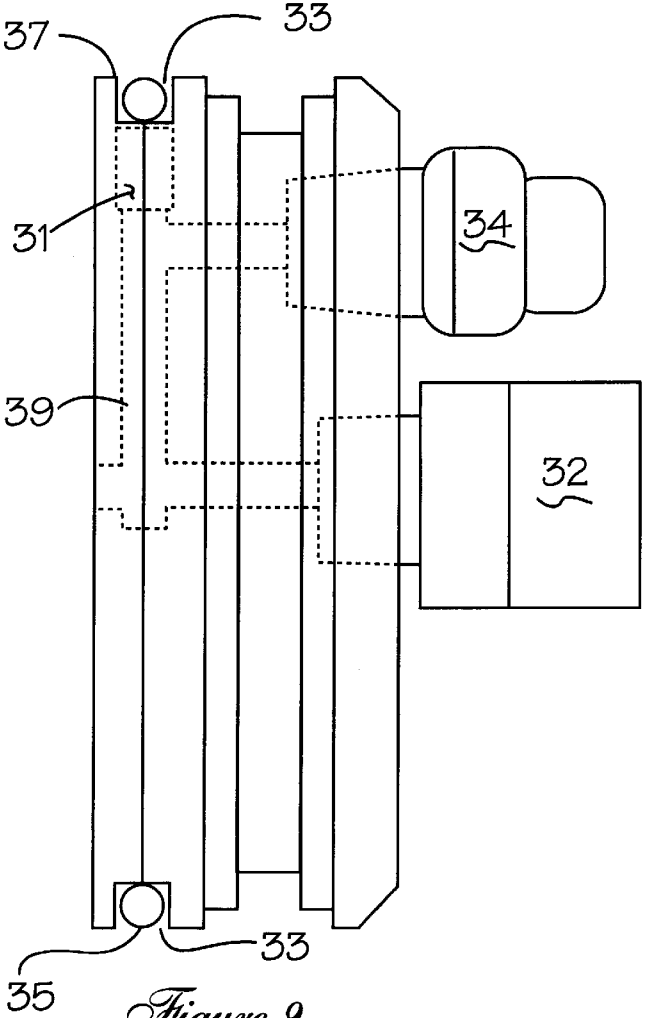
FIG. 9 is a side view of the alternative end cap shown in FIG. 8.

Bore 38 for the pressure relief valve 34 is a blind hole that ends within the body of the top end cap 14, as better observed with reference to the enlarged view of the end cap depicted in FIGS. 9 and 10. A cross-channel 39 is drilled in the side of the top end cap 14 prior to electromagnetic forming, to provide communication between bores 36 and 38. The quick disconnect outlet 32 is used to draw off the hydrogen produced by the hydride contained within the body 12 of the canister 30. In the event that the pressure becomes excessive, the pressure relief valve 34 will vent the excessive hydrogen build-up, to prevent damage to the canister 30, via the cross-channel 39.

The top end cap 14 is additionally provided with a second circumferential groove or recess 33 that accommodates a wiper O-ring 35. The wiper O-ring 35 prevents hydride material from passing between the end cap 14 and the aluminum body 12.

Referring again to FIG. 9, a set screw or pressure plug 37 is provided for adjusting the escape of hydrogen in channel 39. The pressure plug 37 extends into the channel 39 at point 31, and pinches off the channel 39 in order to adjust the pressure feed.

Figure 12:
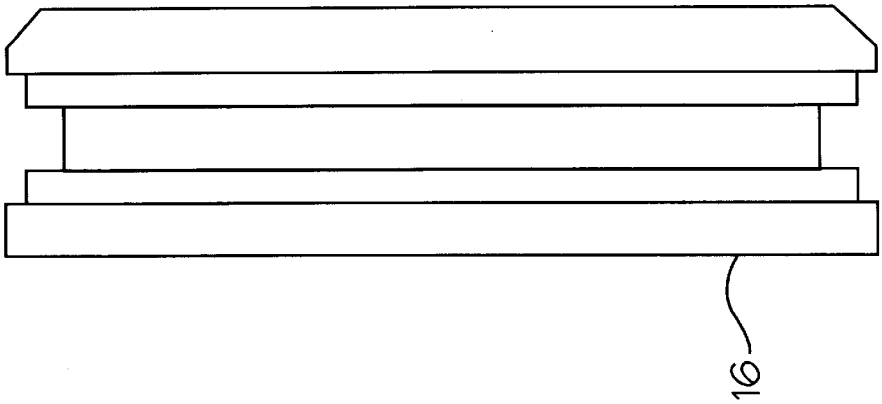
FIG. 12 is a side view of the end cap shown in FIG. 11.
Figure 11:
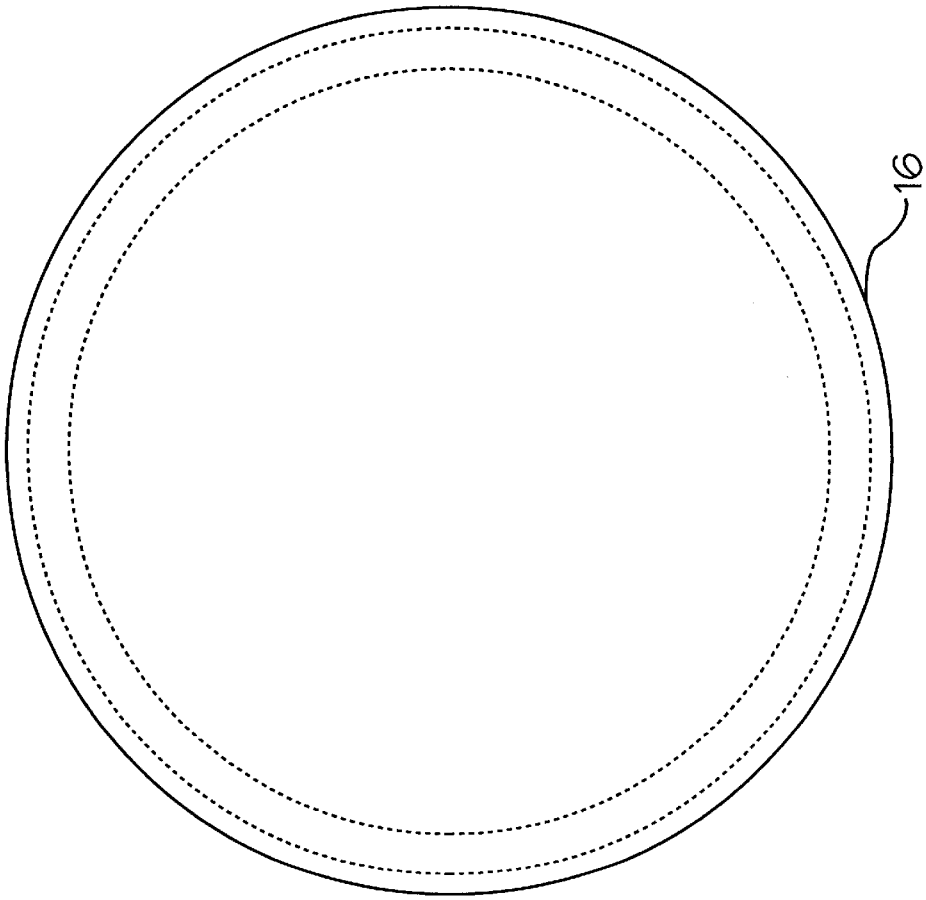
FIG. 11 is a top view of the other end cap of the canister depicted in FIG. 8.

Referring to FIGS. 11 and 12, the bottom end cap 16 is shown in plan and side views, respectively.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A pressure vessel, comprising a pressurizable canister, said canister including a hollow, thin-walled, light weight cylindrical, metal shell, said metal shell being formed about two distally disposed end caps comprising a top end cap and a bottom end cap, respectively, said metal shell being mechanically sealed to each respective end cap by a process of electromagnetic pulse forming, said respective end caps comprising a high strength, ductile thermoplastic that will withstand the electromagnetic deforming forces induced in the mechanical sealing, whereby a mechanical bond is established between said metal shell and of said end caps wherein the material of said tube and said end caps become integrally and directly bonded one to the other with no intervening material therebetween.

2. The pressure vessel of claim 1, wherein each respective end cap comprises acetal resin.

3. The pressure vessel of claim 1, wherein each respective end cap comprises means defining at least one circumferential groove for receiving the deformed metal of the canister shell.

4. The pressure vessel of claim 1, wherein each respective end cap circumferential groove has an O-ring disposed therein.

5. The pressure vessel of claim 1, wherein each respective end cap is formed by injection molding.

6. The pressure vessel of claim 1, wherein each respective end cap comprises reinforcement fibers disposed therein.

7. The pressure vessel of claim 3, wherein each respective end cap comprises means defining a first and second circumferential groove, said second circumferential groove containing an O-ring disposed therein.

8. The pressure vessel of claim 1, wherein said canister can accommodate a pressure of at least approximately 300 psi.

9. The pressure vessel of claim 1, wherein said metal shell of said canister comprises aluminum.

10. The pressure vessel of claim 1, wherein each respective end cap comprises a thermoplastic material.

11. The pressure vessel of claim 1, further comprising a quick disconnect outlet disposed in said top end cap for drawing off gaseous materials from within said pressure vessel.

12. The pressure vessel of claim 1, further comprising a pressure relief valve disposed in said top end cap for relieving excess pressure in said pressure vessel.

13. The pressure vessel of claim 12, further comprising a pressure relief valve disposed in said top end cap and fluidly communicating with a quick disconnect outlet for relieving excess pressure in said pressure vessel.

14. The pressure vessel of claim 12, wherein said pressure relief valve comprises means for adjusting said excess pressure.

* * * * *